US005308143A

United States Patent [19]

Cheng et al.

[11] Patent Number: 5,308,143

[45] Date of Patent: May 3, 1994

[54] SAFETY ROCKER FOR AN INFANT SEAT

[75] Inventors: Kenny Cheng, Taipei; Scott Lin, Taipei Hsien, both of Taiwan

[73] Assignee: Joanna A. Nichols, Baldwin Park, Calif.

[21] Appl. No.: 983,706

[22] Filed: Dec. 1, 1992

[30] Foreign Application Priority Data

Sep. 23, 1992 [TW] Taiwan ..... 81212880

[51] Int. Cl.[5] ..... A47D 13/10

[52] U.S. Cl. ..... 297/292; 297/440.11; 297/301

[58] Field of Search ..... 297/292, 291, 285, 300, 297/301, 258, 270, 354, 354.1, 441, 440.11, 32, 16, 16.1, 272, 296, 440, 440.1

[56] References Cited

U.S. PATENT DOCUMENTS

| | | | |
|---|---|---|---|
| 376,886 | 1/1888 | Holden | 297/292 |
| 704,774 | 7/1902 | Blackledge | 297/258 X |
| 2,266,092 | 12/1941 | Springer | 297/258 |
| 3,110,519 | 11/1963 | Chernivsky | 297/285 |
| 3,743,352 | 7/1973 | Kallander | 297/285 |
| 4,553,786 | 11/1985 | Lockett, III et al. | 297/440 |
| 4,976,494 | 12/1990 | Polley | 297/296 X |
| 5,178,438 | 1/1993 | Beger | 297/270 X |
| 5,207,478 | 5/1993 | Freese et al. | 297/296 |

*Primary Examiner*—Kenneth J. Dorner
*Assistant Examiner*—Milton Nelson, Jr.
*Attorney, Agent, or Firm*—Fish & Richardson

[57] ABSTRACT

A safety rocker or an infant seat includes a foot piece, a support bracket, two clips, two sets of pads, an upper frame, a lower frame, an inner fastener, a torsion coil spring, an outer fastener, a bolt, a swivel head, and a seat cover. The two clips are mounted on the foot piece near the bend point in order to attach the support bracket to the foot piece. The support bracket can be detached from these two clips to fold up the rocker when it is not in use. A swinging mechanism is constructed by using the bolt to penetrate the lower frame, the inner fastener, the torsion coil spring, the outer fastener, and the support bracket. Then, the swivel head is engaged with the bolt such that the lower and upper frames can limitedly rotate about the bolt with respect to the support bracket. The swivel head can be locked by engaging the inner and outer fasteners together if the rotation of the lower and upper frames with respect to the support bracket is not intended.

5 Claims, 5 Drawing Sheets

SAFETY ROCKER FOR AN INFANT SEAT

BACKGROUND OF THE INVENTION

1. Field of the Invention

This invention relates to a safety rocker for an infant seat and, more particularly, to a rocker which has a very simple structure and can be folded into small volume of easy carrying.

2. Description of the Related Art

For centuries it has been appreciated that rocking a reclining child can induce or at least relax the child. Conventionally, an infant seat is designed so that the entire seat rocks up and down. However, such an infant set is satisfactorily stable. In addition, the rocking angle of the infant seat is not controllable, and thus it is very dangerous for the infant.

Therefore, it is an object of the present invention to provide a safety rocker for an infant seat. When the rocker is rocked up and down, the foot piece and the support bracket are motionless and the upper and lower frames are rocked with respect to the support bracket so as to ensure safety.

It is a further object of the present invention to rock a child in a safe, comfortable, convenient and efficient manner.

It is still a further object of the present invention to provide a safety rocker for an infant seat in which the seat covers can be easily removed from the frame for cleaning.

SUMMARY OF THE INVENTION

The present invention provides a safety rocker for an infant seat. The rocker includes a foot piece, a support bracket, two clips, two sets of pads, an upper frame, a lower frame, an inner fastener, a torsion coil spring, an outer fastener, a bolt, a swivel head and a seat. The two clips are mounted on the foot piece near the bend point thereof in order to attach the support bracket on the foot piece. When the rocker is not in use, the user may detach the support bracket from these two clips to fold up the rocker. A swinging mechanism is constructed by using the bolt to penetrate the lower frame, the inner fastener, the torsion coil spring, the outer fastener and the support bracket, and then threadedly engaging the swivel head with the bolt. The lower and upper frames can limitedly rotate about the bolt with respect to the support bracket. If the rotation of the lower and upper frames with respect to the support bracket is not intended, the user can lock the swivel head to engage the inner and outer fasteners together so as to fix the lower and upper frames on the support bracket.

BRIEF DESCRIPTION OF THE FIGURES

For a fuller understanding of the nature and objects of the present invention, reference should be had to the following detailed description taken in conjunction with the accompanying drawings in which.

DETAILED DESCRIPTION OF PREFERRED EMBODIMENTS

Figure 1:
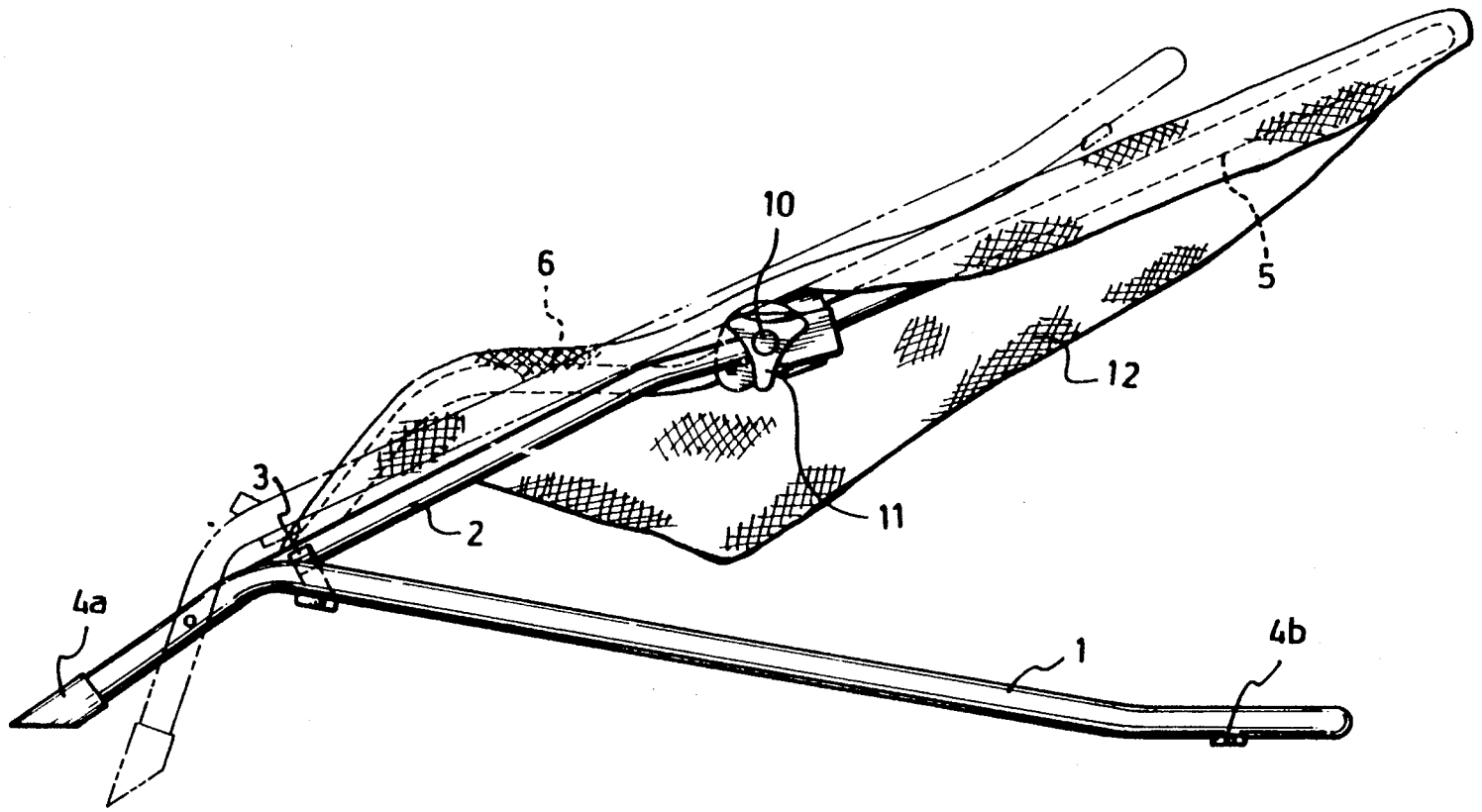
FIG. 1 is a side view of the present invention.

With reference to FIG. 1, the safety rocker according to the present invntion comprises a foot piece (1), a support bracket (2), two clips (3), two sets of pads (4*a* and 4*b*), an upper frame (5), a lower frame (6), an inner fastener (7), a torsion coil spring (8), an outer fastener (9), a bolt (10), a swivel head (11) and a seat (12). Two sets of pads (4*a* and 4*b*) can prevent the safety rocker from sliding on the ground. Two clips (3) are used to fix the support bracket (2) on the foot piece (1). When the rocker is not in use, the user may detach the support bracket (2) from these two clips (3) and then rotate the foot piece (1) with respect to the support bracket (2) so as to fold up the safety rocker into a small volume for easy storage and carry. The seat is made of a plate and cloth and can be worn on the seat frame constructed by the upper frame (5) and lower frame (6). Thus the user can easily remove the seat (12) from the seat frame for cleaning.

Figure 2:
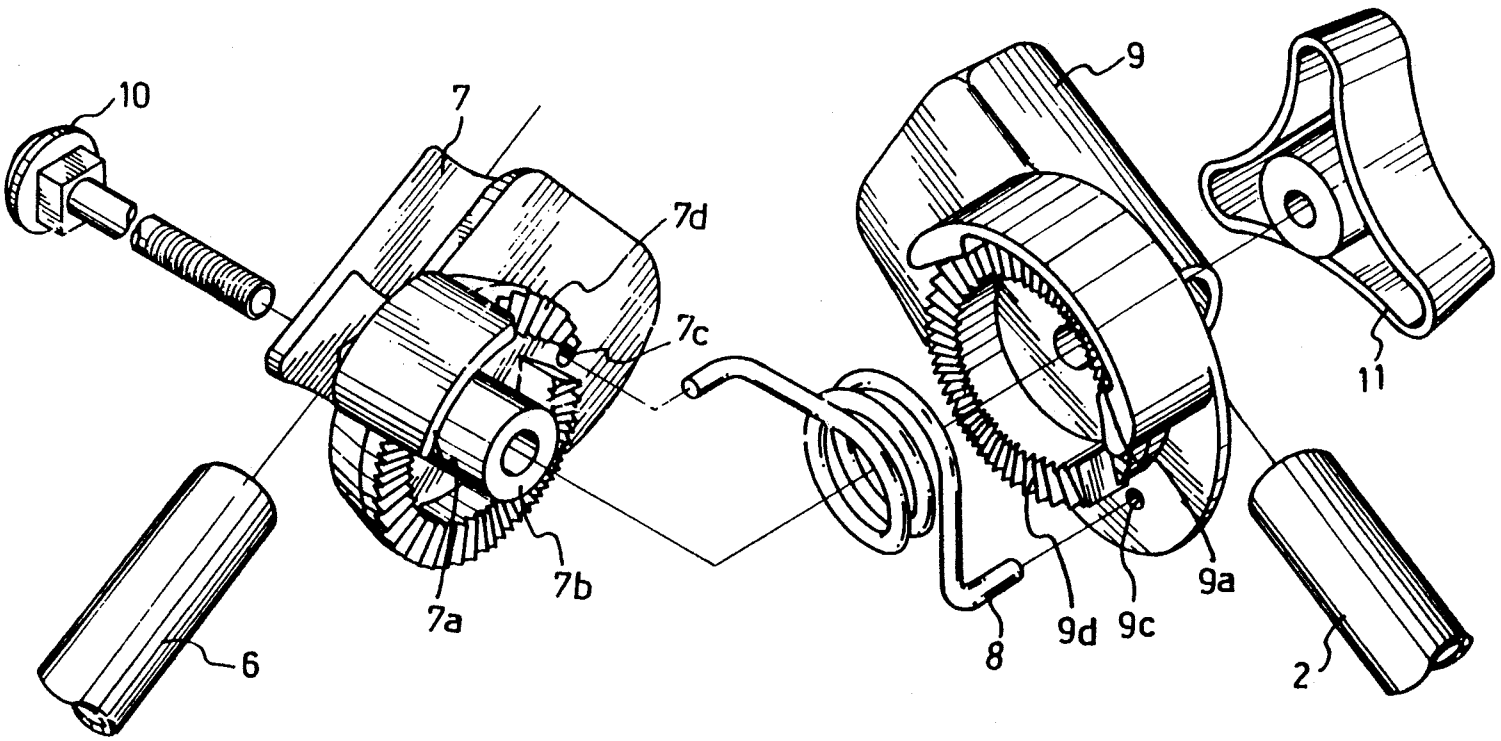
FIG. 2 is a view showing the structure of the swinging mechanism according to the present invention.

FIG. 2 further explains the swinging mechanism according to the present invention. The swinging mechanism is constructed by using the bolt (10) to penetrate the lower frame (6), the inner fastener (7), the torsion coil spring (8), the outer fastener (9) and the support bracket (2), and then threadedly engaging the swivel head (11) with the bolt (10). One end of the torsion coil spring is fixed in the hole (7*c*) of inner fastener (7). The other end of the torsion coil spring is fixed in the hole (9*c*) of outer fastener (9), while the coil portion of the spring is mounted on the cylindric protrusion (7*b*) of the inner fastener (7). The inner fastener (7) has an actuate stopper 7(*a*). The outer fastener (9) has an arcuate recess portion (9*a*). The arcuate stopper (7*a*) is accommodated in the arcuate recess portion (9*a*) to limit the rotation angle between the inner and outer fasteners.

Figure 3B:
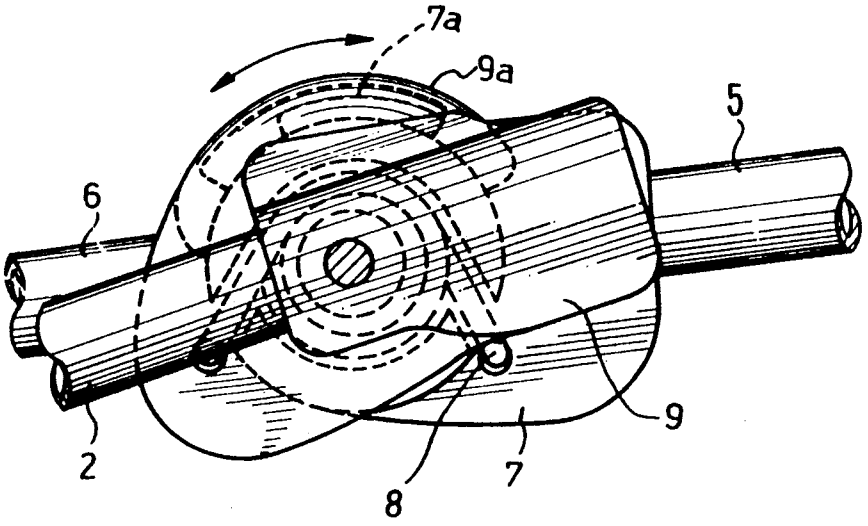
FIGS. 3*a* and 3*b*, respectively, show the angle limitation of the swinging mechanism according to the present invention.
Figure 3A:
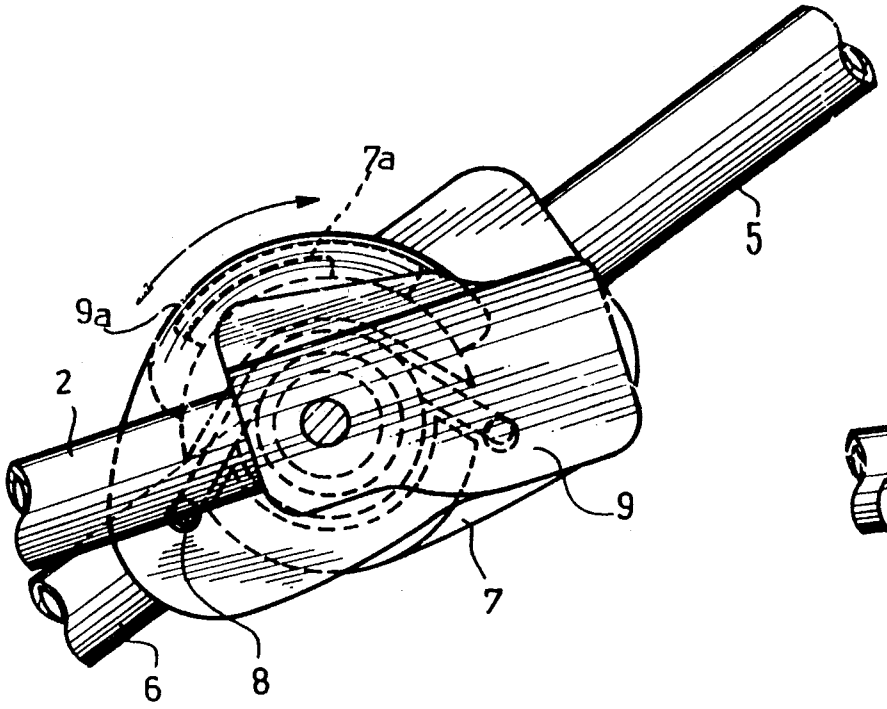

FIGS. 3*a* and 3*b* are sectional view of the swinging mechanism showing the limitation of the rotation angle.

Figure 4B:
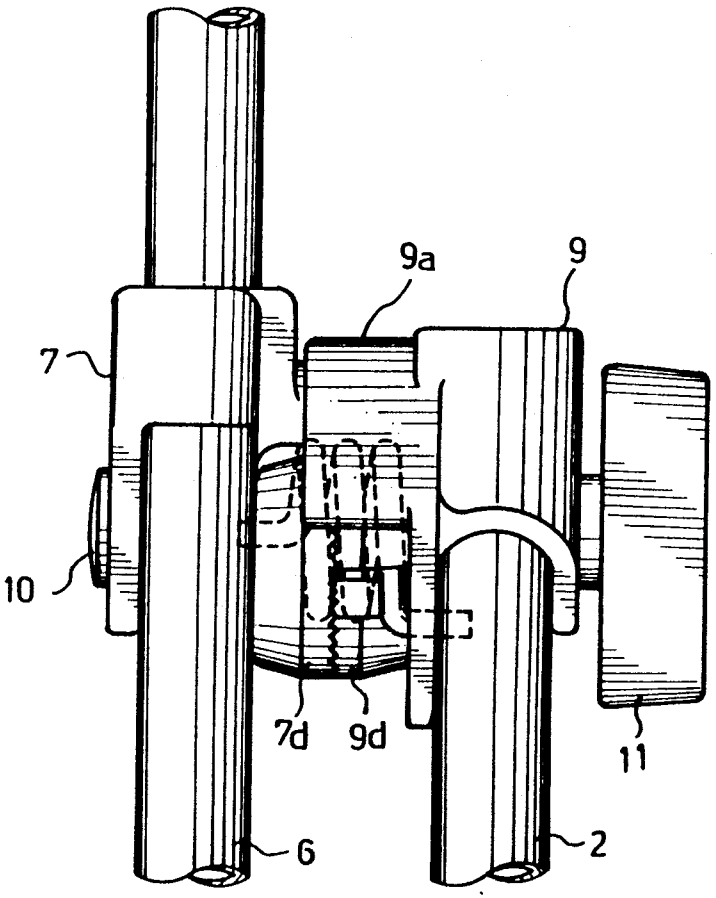
FIGS. 4*a* and 4*b*, respectively, show the unlocked and locked states of the swinging mechanism according to the present invention.
Figure 4A:
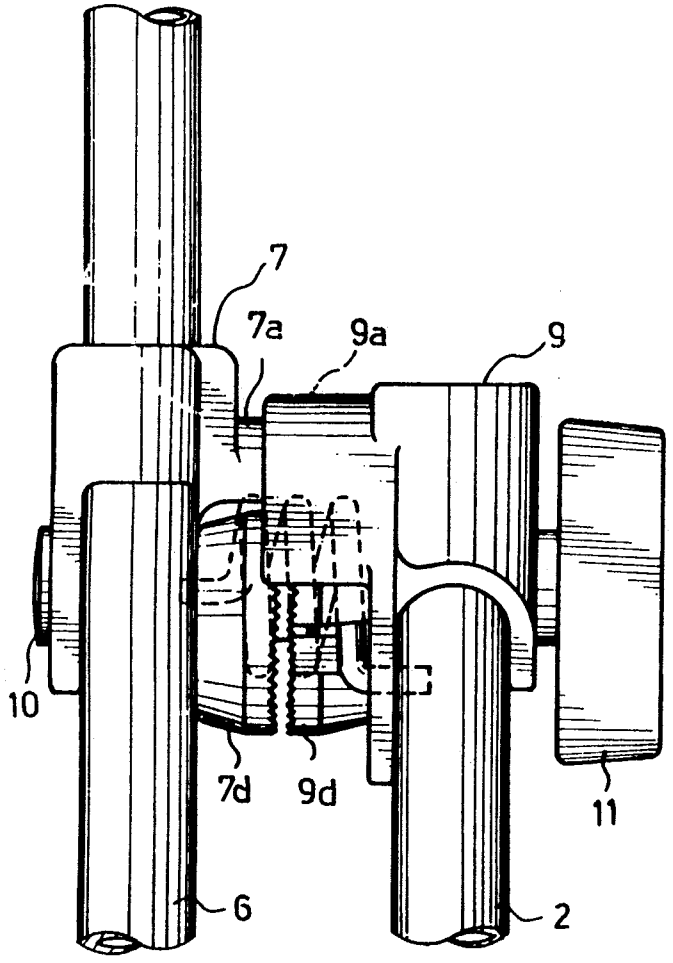
Figure 5:
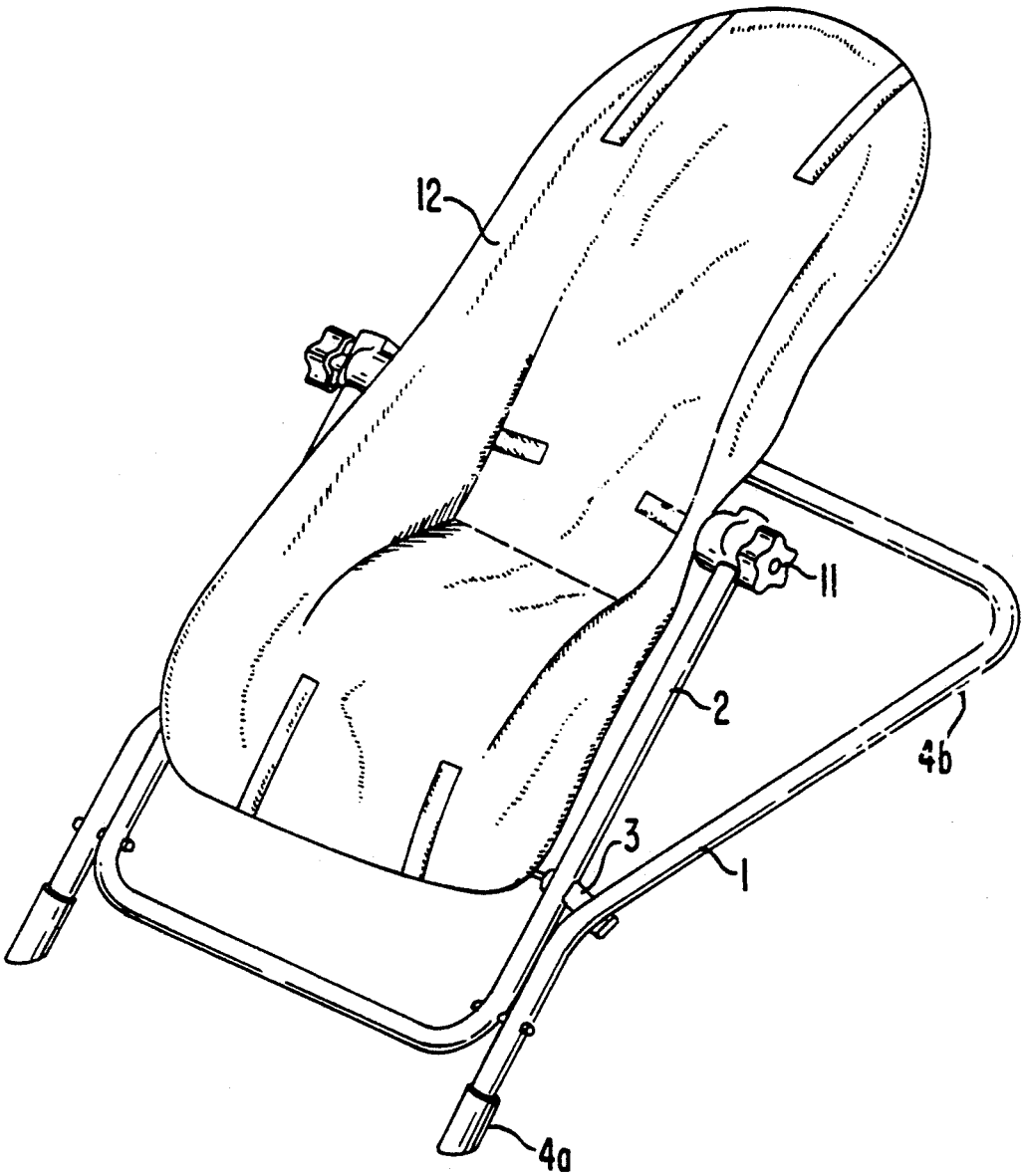
FIG. 5 is a perspective view of the present invention.

FIGS. 4*a* and 4*b* respectively show the unlocked and locked states of the swinging mechanism. The inner fastener (7) and the outer fastener (9) have teeth portions (7*d*) and (9*d*) of even pitch, respectively. If the rotation of the lower and upper frames with respect to the support bracket is not intended, the user can lock the swivel head to engage the inner and outer fasteners together so as to fix the lower and upper frames on the support bracket.

As described above, the structure of the safety rocker according to the present invention is very simple. The rocker can be folded into small volume of easy storage and carrying. Further, the foot piece and the support bracket are motionless and the upper and lower frames limitedly rotated with respect to the support racket so as to ensure safety when the rocker is rocked up and down. The safety rocker according to the present invention is novel and inventive with outstanding results.

The present disclosure includes that contained in the appended claims as well as that the foregoing description. Although the present invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the present invention.

We claim:

1. A safety rocker or an infant seat, said rocker comprising:

a foot piece;

a support bracket;

at least one clip, wherein said clip is mounted on the foot piece near a bend point thereof to fix said support bracket on said foot piece;

two sets of pads, wherein said two sets of pads are disposed on said foot piece;

an upper frame;

a lower frame;

an inner fastener;

an outer fastener;

a bolt;

a swivel head;

a seat; and a swinging mechanism constructed by using said bolt to penetrate said lower frame, said inner fastener, said torsion coil spring, said outer fastener, and said support bracket, and then threadedly engaging said swivel head with said bolt such that said lower frame and said upper frame can limitedly rotate about said bolt with respect to said support bracket, wherein said support bracket can e detached from said clip to fold up the rocker when the safety rocker for an infant seat is not in use;

said swivel head is locked by engaging said inner fastener and said outer fastener together to fix said lower frame and said upper frame on said support bracket if the rotation of said lower frame and said upper frame with respect to said support bracket is not intended.

2. The safety rocker, as defined in claim 1, further comprising a seat frame constructed by said upper frame and said lower frame and wherein said seat is worn on said seat frame constructed by said upper frame and lower frame such that said seat can be easily detached from said seat frame for cleaning.

3. The safety rocker, as defined in claim 1, wherein said inner fastener and said outer fastener, respectively, have teeth portions of even pitch, and said teeth portions can be engaged together to lock said inner fastener and said outer fastener.

4. The safety rocker, as defined in claim 1, further comprising a torsion coil spring and wherein one end of said torsion coil spring is fixed in a hole of said inner fastener and the other end of said torsion coil spring is fixed in a hole of said outer fastener.

5. The safety rocker, as defined in claim 1, wherein said inner fastener has an arcuate stopper and said outer fastener has an arcuate recess portion such that said arcuate stopper can be accommodated in said arcuate recess portion to limit a rotation angle between said inner fastener and said outer fastener.

* * * * *